United States Patent [19]

Fiocchi

[11] 4,282,714

[45] Aug. 11, 1981

[54] EXPLOSIVE ACTUATED TOOLS FOR DRIVING ANCHORING MEMBERS

[75] Inventor: Guilio Fiocchi, Milan, Italy

[73] Assignee: Berfi S.p.A., Milan, Italy

[21] Appl. No.: 111,164

[22] Filed: Jan. 10, 1980

[30] Foreign Application Priority Data

Jan. 23, 1979 [IT] Italy ..... 20575/79[U]

[51] Int. Cl.[3] ..... B25C 1/14

[52] U.S. Cl. ..... 60/632

[58] Field of Search ..... 60/632, 633, 634, 635, 60/636, 637, 638

[56] References Cited

U.S. PATENT DOCUMENTS

| | | | |
|---|---|---|---|
| 2,008,362 | 7/1935 | Littlehale | 60/636 X |
| 2,132,148 | 10/1938 | Davis | 60/632 |
| 2,483,112 | 9/1949 | Temple | 60/632 |
| 2,518,395 | 8/1950 | Sopris | 60/638 |
| 3,494,125 | 2/1970 | Robinson | 60/636 |
| 3,548,590 | 12/1970 | Mulno | 60/636 |
| 4,189,081 | 2/1980 | Combette et al. | 60/635 |
| 4,196,834 | 4/1980 | Beton | 60/635 |

FOREIGN PATENT DOCUMENTS

| | | | |
|---|---|---|---|
| 248104 | 4/1963 | Australia | 60/635 |
| 824790 | 12/1959 | United Kingdom | 60/632 |

*Primary Examiner*—Wendell E. Burns

*Attorney, Agent, or Firm*—Haseltine and Lake

[57] ABSTRACT

In an explosive actuated tool for driving anchoring members, for instance nails and the like, in which the extraction and the ejection of the cartridge case, after the firing phase, are ensured through a mechanism comprising a sleeve, slidably engaged with the barrel and embracing it, a pawl protruding from the sleeve being engaged in a Z shaped groove formed in the internal surface of the breech tube, whereby the sliding motion of the sleeve together with the barrel, during the slipping off motion of the latter with respect to the breech tube of the tool, is stopped when the said pawl stops against the cross portion of the said Z shaped groove, thus having the sleeve axially displaced with respect to the barrel against the counter force of return springs, in this phase half bottom of the firing chamber, as formed by the sleeve being rearwardly displaced with respect to the other half bottom, as formed by the end of the barrel itself.

4 Claims, 13 Drawing Figures

IV
V
VI
VIII
22
23
25
27
35
36
37
38
39
40
41
42
43
45
47
48

EXPLOSIVE ACTUATED TOOLS FOR DRIVING ANCHORING MEMBERS

The present invention relates to an explosive actuated tool for driving anchoring members, and more particularly to an improvement in the ejecting mechanism for the cartridge case of the cartridge case of the said tool.

As it is known, this type of tool is usually used for driving nails or other kinds of pointed members thanks to the action of an explosive charge and normally comprises a barrel having a piston slidably housed thereinto; the piston owing to the action of the gases developed by the explosion of an explosive charge, does act onto the head of the nail, previously inserted in the barrel through one end thereof, thus driving it into the material against which the tool muzzle is abutted.

Of course, as the explosive charge there is normally used a cartidge, which involves a cartridge case to be ejected after the firing by means of a suitable ejecting mechanism.

It is evident that these tools are very similar to the fire arms, whereby at least for some components thereof (such as for instance the firing pin, the mechanism for the ejection of the cartridge case, etc.) much recourse has been and is made to the technology of the fire arms. However, unlike the fire arms, these tools are used in several fields among which in the building industry, particularly in the erecting yards, and are handled by unskilled labour, whereby from one side extremely rigorous safety criteria must be met, (for instance the actuation of the firing mechanism is normally subordinated to the consent as determined from the abutment of the muzzle end against the surface into which the nail must be driven, the said abutment involving a pressure higher than a predetermined value), and from the other side mechanisms are to be foreseen of ready and safe operation and maintenance, to prevent a quick deterioration of the tool due to poor and/or insufficient maintenance and/or frequent cloggings of the tool.

There is already known an ejecting mechanism for the cartridge case in which part of the bottom of the slidable barrel, in which the firing chamber is provided, is rearwardly displaced for a short lenght with respect to the plane of the said bottom, so as to partially clear the cartridge case by acting on the protruding perimetral edge of the case.

In the conventional embodiments, as known up to date, such a displacement is carried out by means of a mechanical action, as helped by a spring housed in a proper seat provided internally of the barrel body, whereby the take off motion of the barrel for the recharging causes the cartridge case to be preliminarily extracted.

The main purpose of the present invention is that of providing an explosive actuated tool for driving anchoring means of improved type, in which, the operation characteristics as above briefly mentioned being the same, the extraction of the cartridge case takes place not only fully automatically, but also certainly, the extraction-ejection-charging cycle is very fast and lastly a completely closed firing chamber, i.e. the chamber containing the cartridge, is provided. These purposes are essentially achieved by means of an explosive actuated tool for driving anchoring members, of the type comprising a barrel slidable in a breech tube, having a central bore in which a driving piston is slidably housed, the rear end of the said barrel forming a firing chamber adapted to receive an explosive cartridge, said tool further comprising a trigger and firing pin mechanism and an extraction and ejection mechanism for the cartridge case, characterized in that said extraction and ejection mechanism comprises a sleeve, slidably mounted to the said barrel, and having a bottom half adapted to complete the base part of the said firing chamber, a tooth protruding from the outer surface and slidably engaged in a groove formed in the inner surface of the said breech tube, so as to stop at a predetermined point of the sliding motion the displacement of the sleeve together with the barrel, and spring means opposing the sliding motion of the sleeve with respect to the barrel when the latter is slipped off the breech tube. The peculiar features and the advantages of the present invention will more clearly appear from the following description given with respect to the enclosed drawings showing a preferred embodiment of the invention, without having any limiting purpose.

Figure 1:
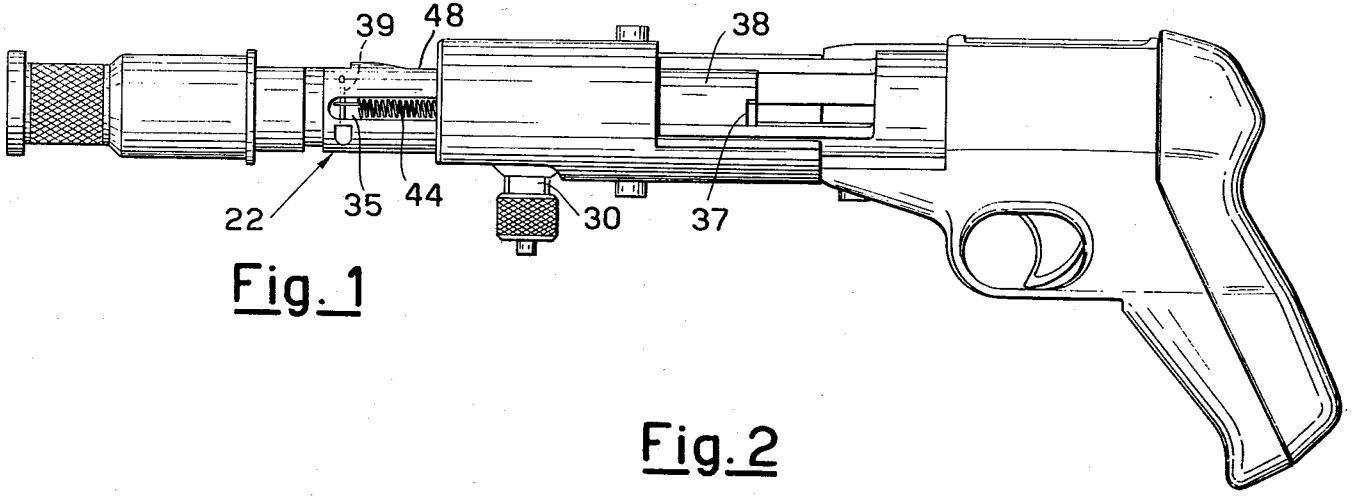
FIG. 1 is a side view of the tool of the invention.
Figure 2:
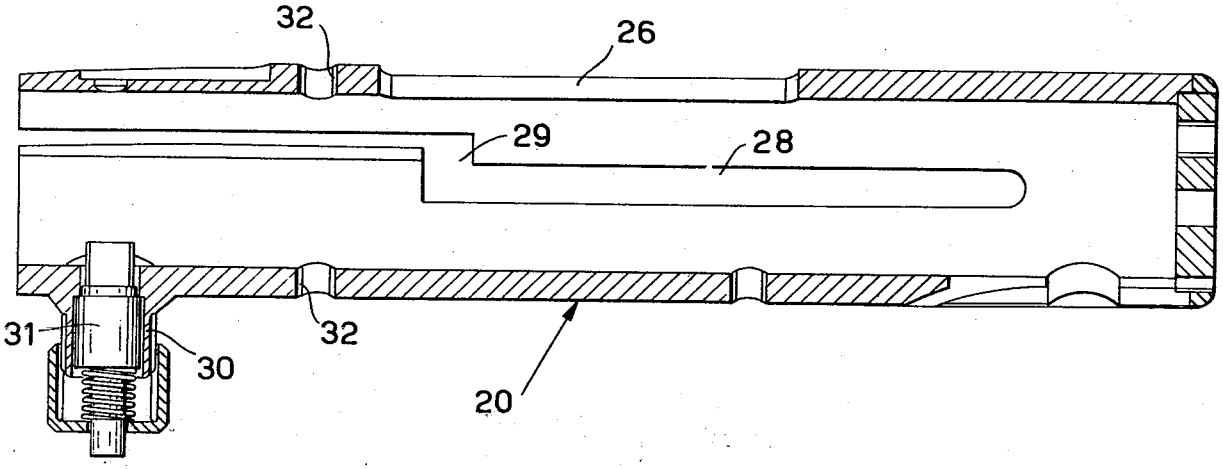
FIG. 2 is a longitudinal cross-section view of the breech tube.
Figures 3, 4, 5, 6, 7, 8, 9:
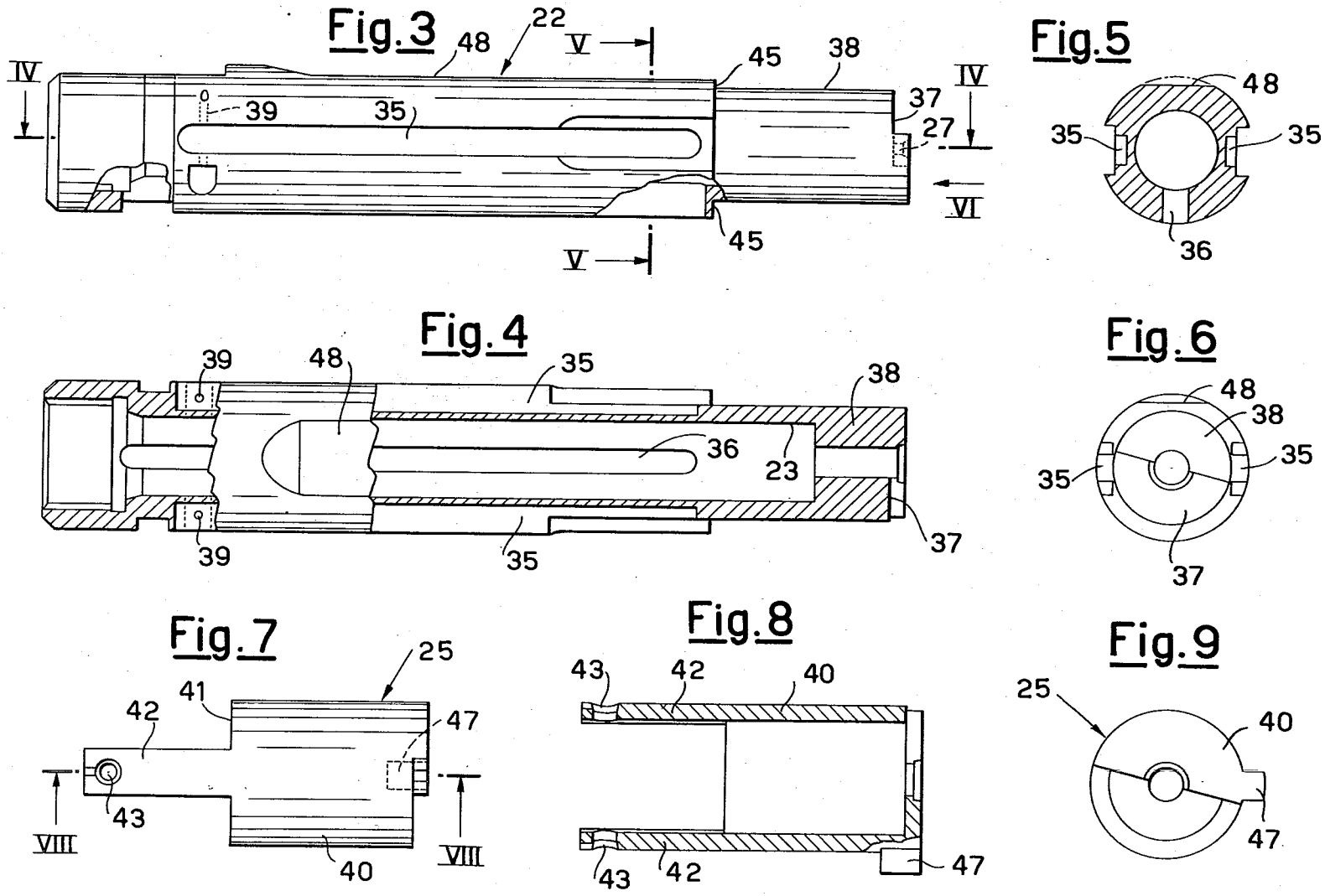
FIG. 3 is a side, partially cross-sectional view of the barrel.
FIGS. 4 and 5 show cross-section views taken along the planes IV—IV and V—V of FIG. 3.
FIG. 6 is an end view of the barrel from the side of the firing chamber.
FIG. 7 is a side elevation view of the extracting mechanism.
FIG. 8 is a cross-section view, taken along the plane VIII—VIII of FIG. 7.
FIG. 9 is a view of the extraction mechanism from the end of the firing chamber.

Referring to the drawings and particularly to the FIGS. 1–9, the explosive actuated tool for driving anchoring members of the invention comprises a breech tube 20, having a trigger and firing pin mechanism mainted thereto (it being not shown in detail), which is generically shown by the reference 21, and a barrel 22, having an axial bore 23 in which a driving piston 24 is slidably housed, an extraction mechanism 25 being coupled to the barrel.

It is worth to point out that, apart from the extraction mechanism and from some other details, the tool of the invention is of the conventional type, whereby the related description shall be rather summarily given, since features well known in the related art are involved.

The breech tube 20, in the rear part of which the firing pin mechanism is housed, has a side opening 26, permitting the access (when the barrel is completely slipped off the said tube) to the firing or cartridge chamber 27. Furthermore in the breech tube a longitudinal, Z shaped, groove or milled channel is formed, namely having two longitudinal and parallel to each other brances 28, connected by a cross branch 29.

A small sleeve 30 protrudes from the breech tube, by means of which a stop member 31 for the piston 24 is inserted, so as to limit the displacement thereof upon the barrel is slipped of (during the extraction and ejection of the cartride case), and to bring again the piston in the initial position before the firing, thanks to a pin 31A protruding from the maximum diameter of the piston in the groove 36. In order to give the tool a greater strength and to ensure the mechanical resistance of the breech tube, particularly in view of the presence of the Z shaped groove 28–29, a reinforcing sleeve is provided which is fastened to the breech tube by means of screews threaded in the holes 32.

As already mentioned, tha barrel 22 is provided with an axial bore 23, having a diameter adapted to the head 33 and to the stem 34 of the piston 24.

In the outer surface of the barrel 22 there are formed two parallel and opposed grooves 35, having the purpose as hereinafter indicated, whereas a longitudinal slit 36 permits the barrel to slide with respect to the stop member 31.

The bottom 37 of the barrel, in which the cartridge chamber 27 is formed, has a stepped part extending for about 180° of the same bottom, whereby for a predetermined thickness only half perimeter of the cartridge chamber is formed by the bottom of the barrel 22. Furthermore, starting from the bottom 37, the outer surface of the barrel 22 has a portion of reduced diameter, as indicated by the reference 38.

Lastly, at the end of each groove 35 farthest with respect to the bottom 37 a cross member 39 is mounted having the purpose stated hereinafter.

Turning now to more specifically considering the extraction mechanism, the extractor 27 consists of a sleeve 40, adapted to slidably embrace the portion 38 of reduced diameter of the barrel 22. From the front end 41 of the sleeve 40 two tabs 42, parallel and diametrally opposed, protrude, adapted to slidably seat in the grooves 35 of the barrel 22.

At the end of each tab 42 a hole 43 is formed, one end of a counterspring 44 being engaged therewith, whereas the opposite end is engaged with the cross member 39. Thus the springs 44 tend to maintain the sleeve 40 with the end 41 abutted against the end stepped portion 45 of the part of reduced diameter of the barrel 22.

The rear part of the sleeve 40 terminates with a half bottom 46, extending by 180°, whereby in the rest position the half bottom 46, concurs with the bottom part of the barrel 22 to complete the cartridge chamber 27. Lastly from the sleeve 25 a stop pawl 47 radially protrudes, it being adapted to slidably engage the Z shaped groove 28–29 of the breech tube 20. A relief 48, of the well known type, is formed in the outer surface of the barrel, for the engagement with temporary locking balls which correspondingly protrude from the inner surface of the breech tube.

Turning now to the FIGS. 10 to 13, there is detailedly illustrated, in the several phases, the operation of the extraction and ejection mechanism.

After the firing, the attendant causes the barrel to slide forwardly; the sliding motion being permitted by the engagement between the stop pawl 47 and the groove 28, until the pawl abuts the part 29 of the said groove, which acts as a stop member.

Figure 10:
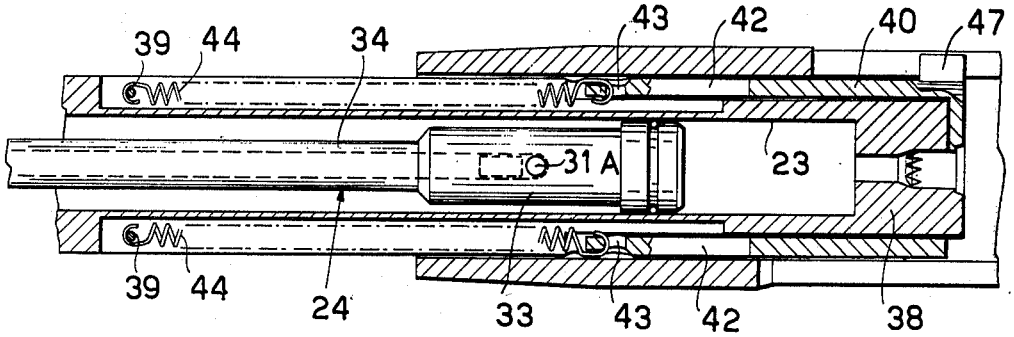
FIGS. 10, 11, 12 and 13, are partial and partially cross-section views of the tool in the several operation phases of the extraction and ejection mechanism.
Figure 11:
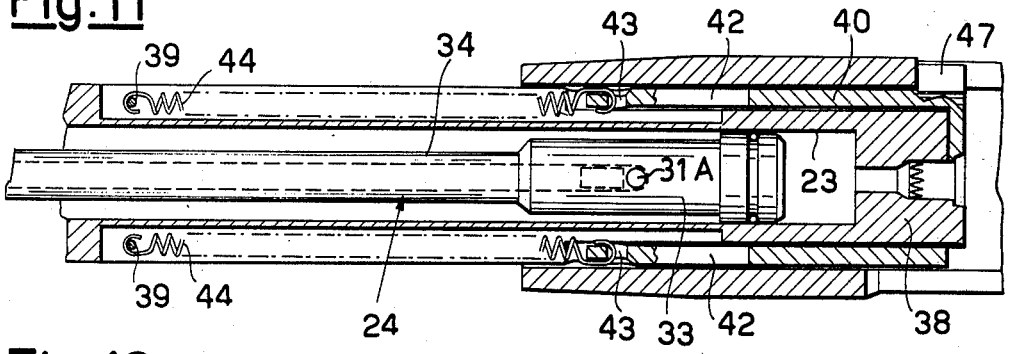
Figure 12:
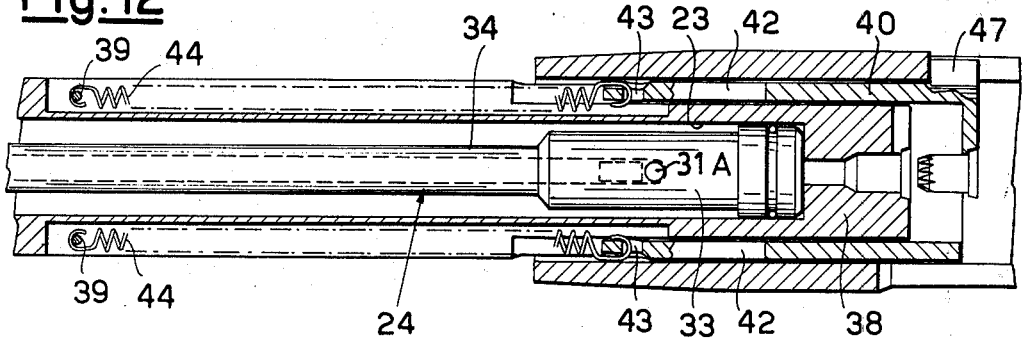
Figure 13:
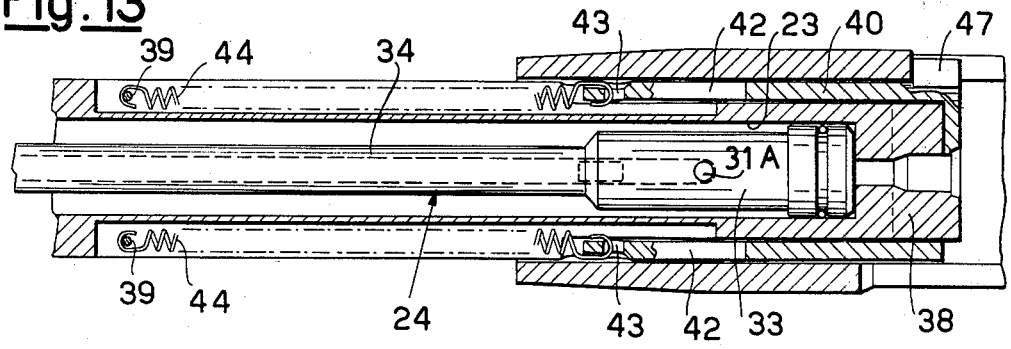

During the said sliding motion, the extraction mechanism, which is in the rest condition and consequently in the closed condition, effects the same displacement as the barrel (FIGS. 10 and 11).

Then the slipping off action of the barrel is continued, against the opposing force of the springs 44 which are consequently stretched, whereas the extraction mechanism is stopped, since the pawl 47 cannot pass the stopping member as formed by the part 29 of the Z shaped groove.

Such a relative displacement between the barrel and the sleeve 40 of the extraction mechanism has a lenght of a few millimeters and is anyhow sufficient to clear for 180° the cartridge case, the latter being thus naturally ejected from the cartridge chamber. By leaving the barrel 22 to itself, it returns by action of the springs 44 in the position of FIG. 13, namely in the closed condition, whereby the tool is again ready for the charging of a new cartridge in the chamber 27, the barrel being thereafter brought in the closed position with respect to the firing mechanism. From the preceding description it is clear that, by the case extraction mechanism of the invention, the opening motion of the tool after the firing, namely the forward displacement of the barrel with respect to the breech tube, causes the extraction and the ejection of the cartridge case to automatically take place, because the relative sliding motion of the barrel with respect to the sleeve of the extraction mechanism automatically occurs at the end of the barrel slipping off displacement, thanks also to the abrupt stopping of the pawl 47 against the stop member 29 and to the inertia as naturally gained by the barrel during the slipping off motion.

Otherwise stated, the division into distinct phases, as previously effected for explanation purposes, does not find practical correspondence, since the slipping off of the barrel (namely opening of the tool) and extraction of the cartridge case take place automatically and with absolute certainty.

The invention has been described with reference to a preferred embodiment, but conceptually and mechanically equivalent modifications and changes are possible and foreseable without falling out of the scope of the invention, in which they are obviously contemplated.

I claim:

1. Explosive actuation tool for driving anchoring members, of the type comprising a barrel slidable in a breech tube, having a central bore in which a driving piston is slidably housed, the rear end of the said barrel forming a firing chamber adapted to receive an explosive cartridge, said tool further comprising a trigger and firing pin mechanism and an extraction and ejection mechanism, characterized in that the extraction and ejection mechanism for the cartridge case after the firing comprises a sleeve slidably mounted to the said barrel and having a half bottom which is complementary with respect to a half bottom provided in the end of the barrel, so as to form a cartridge chamber which is perimetrally perfectly closed, said sleeve comprising a stop pawl, radially protruding and slidably engaged in a groove formed in the internal surface of the said breech tube, so as to stop at a predetermined point the sliding displacement of the sleeve together with the barrel, and spring means opposing to the sliding motion of the sleeve with respect to the barrel in the slipping off motion of the barrel with respect to the breech tube.

2. Explosive actuated tool for driving anchoring members, according to claim 1, characterized in that said sleeve is slidably mounted to a portion of the said barrel having reduced diameter and corresponding length whereby when the said extraction mechanism is closed with respect to the said barrel, the extraction mechanism is complementary with respect to the said barrel, both in the portion forming the cartridge chamber, and in the perimetral portion of the said barrel, said sleeve having two parallel and diametrally opposed arms, slidably extending in two corresponding grooves formed in the outer surface of the said barrel, at the ends of the said arms counter springs being fastened, the other ends of the springs being anchored to fixed parts of the barrel.

3. Explosive actuated tool for driving anchoring members, according to claim 1, characterized in that said groove as formed in the internal surface of the said breech tube is Z shaped, the cross portion of the groove having the function of stopping said pawl during the slipping off displacement of the barrel with respect to the breech tube.

4. Explosive actuated tool for driving anchoring members, according to claim 1, characterized in that a return pin protrudes from the driving piston, it being slidably received in a groove of the said barrel, said pin being slidably engaged during the slipping of the barrel by a stop member, protruding through the same groove of the barrel and fixed to the breech tube.

* * * * *